United States Patent [19]

Christianson

[11] 4,195,744

[45] Apr. 1, 1980

[54] STORAGE CONTAINER FOR MEAT

[76] Inventor: Earl E. Christianson, 4932 46th Ave. South, Seattle, Wash. 98118

[21] Appl. No.: 921,211

[22] Filed: Jul. 3, 1978

[51] Int. Cl.[2] ..... B65D 87/00

[52] U.S. Cl. ..... 220/1.5; 220/334; 232/43.1

[58] Field of Search ..... 220/335, 334, 1.5, 1 T, 220/2, 18, 337-344; 232/43.1, 43.2, 43.3; 294/69 R; 206/599

[56] References Cited

U.S. PATENT DOCUMENTS

| | | | |
|---|---|---|---|
| 1,021,872 | 4/1912 | Kingsbury | 232/43.1 |
| 1,511,982 | 10/1924 | Schilling | 232/43.1 |
| 2,540,698 | 2/1951 | States | 220/1.5 |
| 3,250,429 | 5/1966 | Gesell | 220/74 |
| 3,848,797 | 11/1974 | Kolling | 232/43.1 |
| 3,968,895 | 7/1976 | Barnes, Jr. et al. | 206/599 |

FOREIGN PATENT DOCUMENTS

| | | | |
|---|---|---|---|
| 91659 | 8/1961 | Denmark | 220/1.5 |
| 1046848 | 4/1958 | Fed. Rep. of Germany | 220/1.5 |
| 1308061 | 9/1962 | France | 232/43.1 |
| 388180 | 6/1965 | Switzerland | 220/1.5 |

*Primary Examiner*—Joseph Man-Fu Moy
*Attorney, Agent, or Firm*—Thomas W. Secrest

[57] ABSTRACT

This invention is directed to a container for storing relatively large quantities of materials such as meat. The container is easy to load as the opening is at the top of the container. Also, it is easy to unload the container as part of a side of the container can be lowered so that a person can use a shovel or other convient means to unload the container. Also, the container is positioned on legs. With the container on legs it is possible for the container to receive the prongs of a forklift vehicle and to move the container, empty or full, from place to place.

3 Claims, 5 Drawing Figures

STORAGE CONTAINER FOR MEAT

THE GENERAL BACKGROUND OF THE INVENTION

In meat packing plants small articles such as heart, tongue, liver, bellies, and the like are held at a low temperature or frozen. These small articles are placed in a container and held at the low temperature or frozen until there is a sufficient quantity of these small articles to be, economically, worked into processed meat.

The containers which have been used in the meat packing industry have been, substantially, a box. The box has a bottom, four (4) sides and an open top. The box is easy to load as the small articles of meat can be thrown in by hand. The box holds about 1500 pounds of meat. The difficulty lies in the unloading of the box. Remember, the meat may be at a cold temperature or it maybe frozen. It is possible for a person to unload the box by hand or use a shovel. In any instance, it is necessary to take the meat out through the open top. This is time consuming and annoying and frustrating to a worker. In addition, there is a possibility of a back injury or an injury to the worker. A container which holds 1500 pounds of meat is generally of a good size. It is possible for a worker, when the container is full, to bend over the top of the container and unload the container by hand. Then, when it is more convenient and there is less meat in the container it is possible for the worker to use a shovel to unload the meat. With the use of a shovel the worker crawls into the container or box and shovels the meat out of the box or container and usually throws the meat over his head and over the side of the box or container. Then, this can be annoying and troublesome to the worker and can lead to injury such as a back injury.

THE GENERAL DESCRIPTION OF THE INVENTION

My invention is directed to a container having a bottom, three (3) full sides and a fourth (4th) moveable side with an open top. With all the sides raised in an upright position it is possible for a workman to throw the small articles of meat into the container. Then, when there is a sufficient quantity of small articles of meat to be worked into processed meat it is possible to lower the 4th moveable side and to unload the container at the side. The workman can use a shovel, a short handled shovel or a long handled shovel and unload the meat at the side and distribute the meat at a convenient location. It is not necessary for the workman to shovel the meat over his head or to shovel the meat over the top of the container. The workman can shovel the meat out of the container and at the side of the container.

This makes it possible for a workman to more, quickly, unload the container.

With this manner of unloading the container there is less possibility of a workman injuring himself and also having a back injury as it is not necessary to shovel the meat over the workmans head or over the side of the container.

THE DRAWINGS

THE SPECIFIC DESCRIPTION OF THE INVENTION

Figure 1:
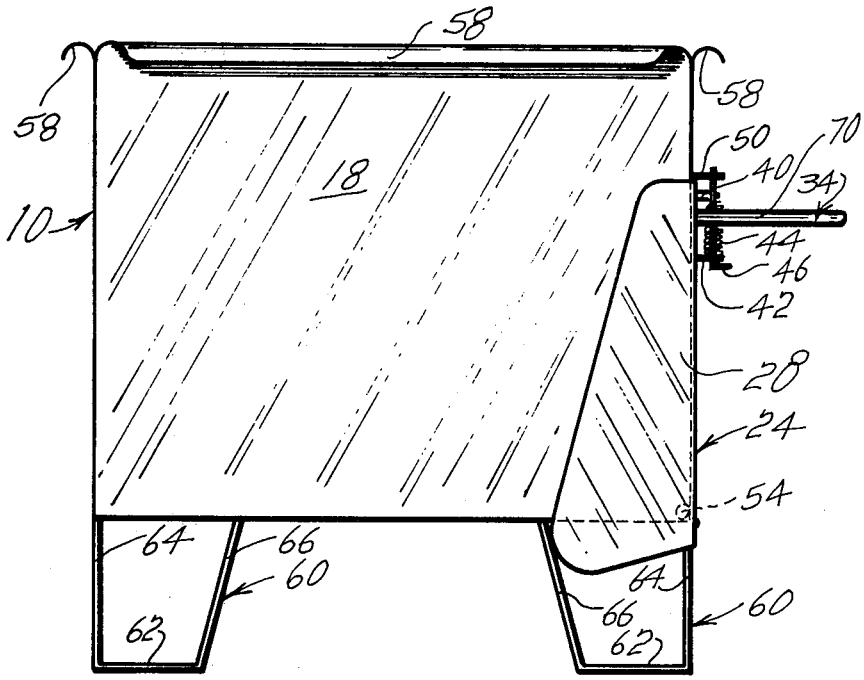
FIG. 1 is a side-elevational view of the container of this invention and illustrates the container as positioned on legs.
Figure 2:
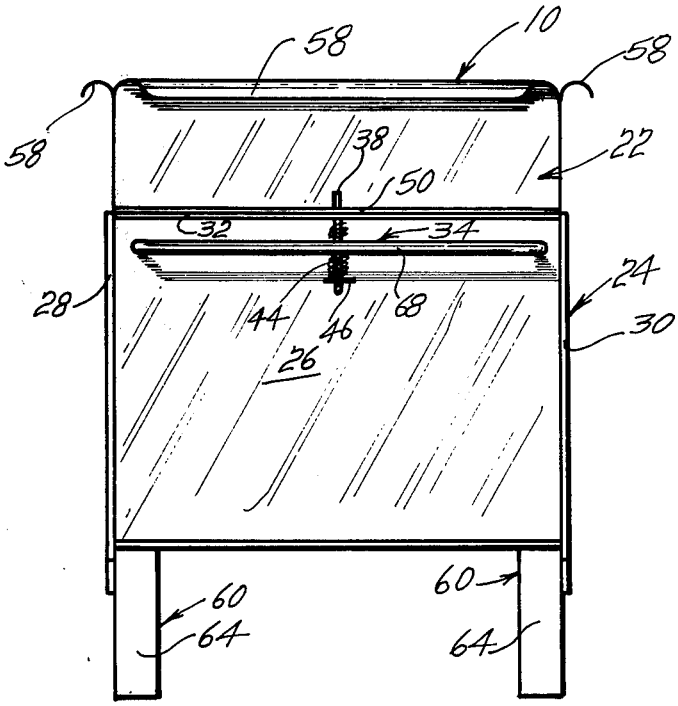
FIG. 2 is a front-elevational view of the container of this invention and illustrates the moveable side of the container.
Figure 3:
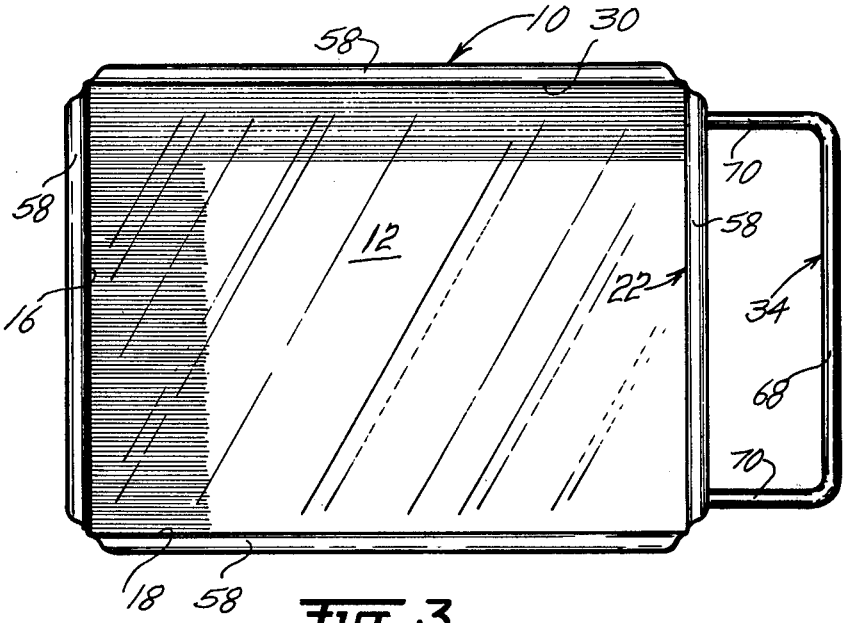
FIG. 3 is a top-plan view of the container of this invention looking into the container.
Figure 4:
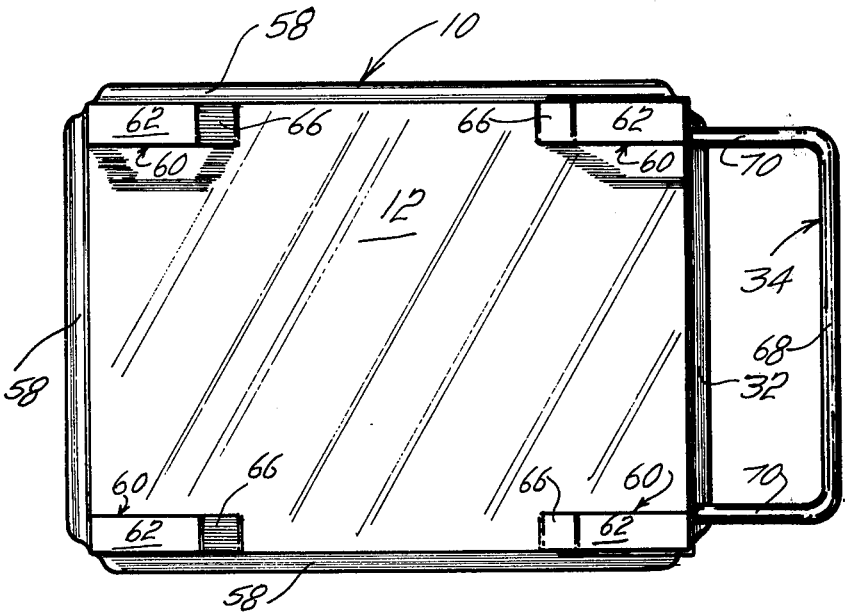
FIG. 4 is a bottom-plan view of the container of this invention looking up at the bottom of the container; and, FIG. 5 is a perspective view of the container of this invention and illustrates the moveable side in a lowered position so that a workman can enter the container through the side and remove the articles in the container by means of a shovel, or by hand.

In the drawings it is seen that the invention comprises a storage container 10.

In the plan view 3 it is seen that the storage container is of a generally rectangular configuration and, it can be realized, maybe of a square configuration.

The container 10 comprises a bottom 12, a first side 14, a first end 16, a second side 18 and a second end 20 having a fixed upper part 22 of the second end. There is a moveable lower part 24 of the second end.

The moveable lower part 24 comprises a base 26 having a first leaf 28 and a second leaf 30. Each of the leafs is, substantially, at a right angle to the base 26 and is directed inwardly to be in an overlapping relationship with a side 14 or side 18.

The outer part of the base 26 has an upward outwardly projecting ledge 32.

On the outer and upper part of the base 26 there is a handle 34 in a generally U-configuration. The handle 34 is attached to the base 26.

In the upper outwardly projecting ledge 32 there is a slot 36. In the slot 36 there is a locking bar 38. The locking bar 38 is positioned by means of a lug 40 and a lug 42. The lugs 40 and 42 have passageways and a locking bar 38 projecting through these passageways and also through the slot 36.

There is a spring 44 wrapped around the locking bar 38 and connecting with the lug 40. The spring 44 also connects with the locking bar 38 and urges the locking bar upwardly through the slot 36. On the lower end of the locking bar 38 there is a leg 46. The leg 46 makes it possible for a person to hold onto the locking bar 38 and press downwardly so as to lower the locking bar 38 with respect to the slot 36.

The fixed upper part 22 of the second end extends from the first side 14 to the second side 18 and connects with these sides. On the lower part of the fixed upper part 22 there is a lower outwardly projecting ledge 50. In the ledge 50 there is a first slot 52. The locking bar 38 projects through the slot 36 in the moveable lower part 24 and also through the slot 52 in the fixed upper part 22 of the second end. This locking bar can lock the moveable lower part 24 in an upright position so that the meat is held in the container 10. To release the moveable lower part 24 it is possible to depress the leg 46 and to move the locking bar 38 away from the slot 52. With the movement of the locking bar 38 away from the slot 52 it is possible to move the lower part 24.

The moveable lower part 24 connects with the bottom 12 of the storage container 10 by means of a hinge 52. The hinge 52 maybe considered to be a piano hinge. The hinge 52 allows the moveable lower part 24 to rotate towards the fixed upper part 22 and also away from the fixed upper part 22.

It is seen that the upper part of the sides and ends are rolled into a rolled upper edge 58. The rolled upper edge lessens the possibility of someone cutting himself on a sharp edge.

It is seen that there are four (4) legs 60. Each of the legs 60 comprises a flat base 62, an upright support 64 and an upright angle support 66. Each of the legs 60 is positioned at a corner, or near a corner, of the storage container end and underneath the bottom 12. In effect, it is seen that each of the legs 60 is, substantially, a loop.

The handle 34 comprises a base 68 and two (2) legs 70. As, previously stated, the handle 34 is attached to the outside surface of the moveable lower part 24.

Figure 5:
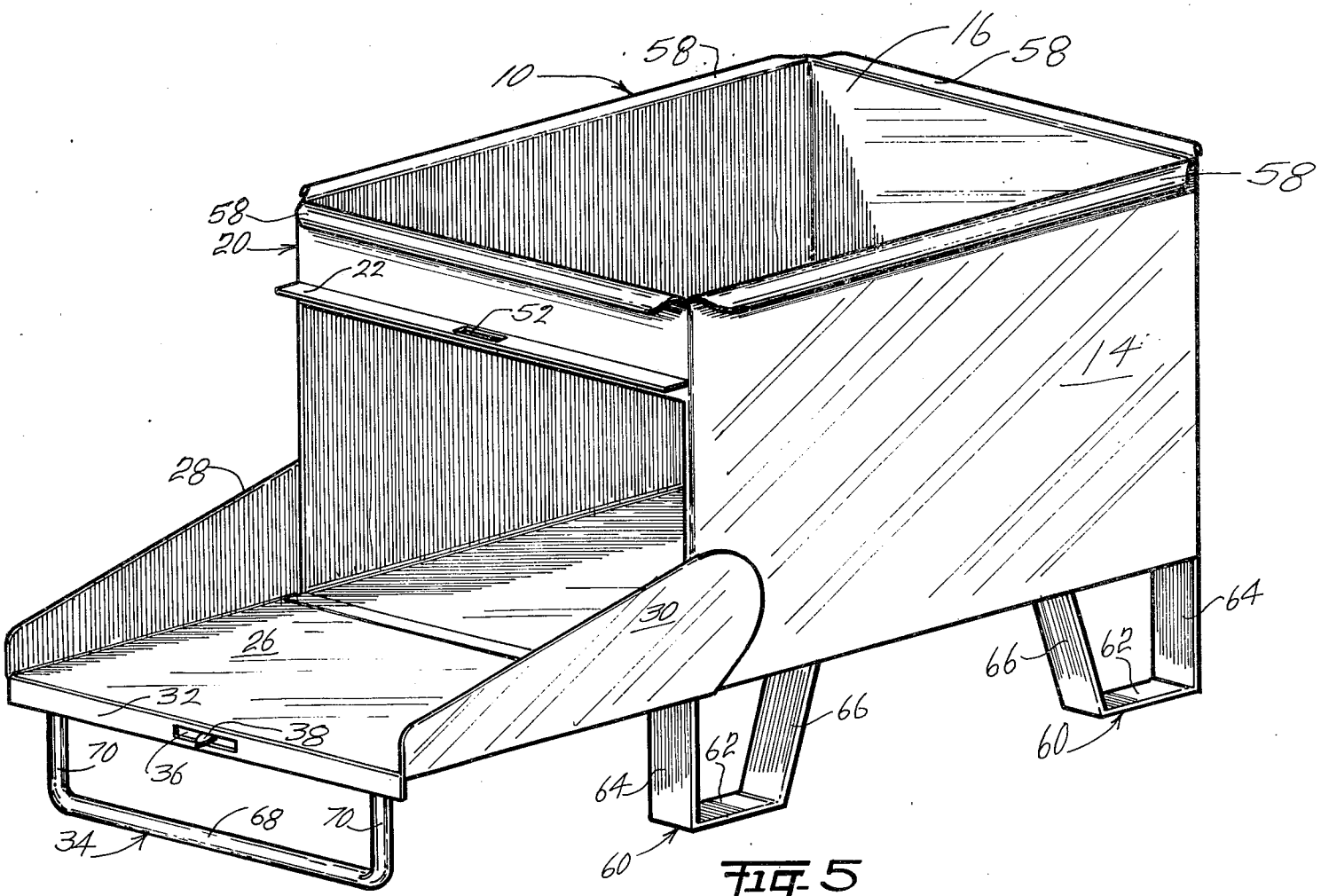

The length of the upright support 64 of the leg 60 is substantially equal to the length of the leg 70 of the handle 34. As is illustrated in FIG. 5 it is seen that the handle 34 can rest on the ground or support, with the moveable lower part 24 in a lowered position, and with the leg 60 resting on the ground or support that the base 26 is substantially flush with the bottom 12 of the storage container 10. This makes it possible to move easily shovel and remove the meat from the storage container 10.

The legs 60, in the configuration of a loop, make it possible for a forklift truck or a forklift vehicle to extend the forks through the loops of the legs and to elevate the storage container 10. The storage container 10 maybe empty or there maybe meat in the storage container 10. With the forklift vehicle elevating the storage container 10 it is possible to move the storage container 10 to a desired location. One of the desired locations maybe to act as a receptacle for receiving the small articles of meat and to store the small articles of meat. The small articles of meat in the storage container then may fill the storage container 10 or only partially fill the container but the storage container can be moved to a freezing section or can be moved to a cold section so as to lessen the possibility of spoilage of the meat. When a sufficient amount of small articles of meat have been collected and there is the proper time and proper place to work these small articles of meat then processed meat can be made from these small articles of meat. The forklift vehicle can transport the storage container 10 with the small articles of meat to the proper location for working these small articles of meat into processed meat. In effect, it is seen that the storage container 10 is a portable storage device which can be used for storing meat until a suitable time for making processed meat and it is possible to move the storage container 10 with the meat from room temperature to a cold or freezing temperature and also to move from a cold or freezing temperature to room temperature.

The storage container 10 can be made of stainless steel.

From the foregoing it is seen that I have provided a storage container which is both easy to load meat into the storage container and easy to remove meat from the container or to unload the container. It is possible for a workman to, easily, shovel the meat out of the container. Because of the ease of unloading the container there is a saving in time by the workman and with the saving in time there is a saving in money which means that it is possible to make processed meat at a lower cost. In addition, there is lessened or eliminated one source of frustration for a worker. The worker need not climb into the storage container and unload the container by hand. Further, the workman need not climb into the storage container and take a shovel to unload the meat from the storage container and need not shovel the meat over his head or need not shovel the meat over the side of the storage container. The workman can lower the side of the storage container and shovel the meat out of the side. There is a result that the workman need not expend as much energy to unload the storage container and can also unload the container more rapidly than if he had to climb into the storage container and remove the meat over the side of the container. Further, it is seen that with my storage container that there is less possibility of injury to the workman and less possibility of back injury to the workman. This means that there is a saving with respect to hospital and doctors bills and also with respect to workmans compensation bills and charges. In addition, this storage container can be readily fabricated from stainless steel or other suitable material, into the desired shape, configuration and size. And, it is seen that with the legs underneath the storage container that it is possible to pick up the storage container and move the storage container to desired locations by means of motor vehicle having a forklift attachment.

In preparing this Patent Application the Patent Search was made. The results from this Patent Search are:

| Patentee: | Patent No.: |
|---|---|
| Arrick | 596,990 |
| Richardson | 577,452 |
| Joern | 1,511,613 |
| Jacobs | 3,202,346. |

From the foregoing and having presented my invention,

What I claim is:

1. A storage container for meat comprising:

a generally rectangular, open-topped box having an opening in one side thereof, said opening extending from the container bottom substantially more than half way to the container top and entirely across the container side;

a door hingeably connected to the container bottom and adapted to completely close said opening, said door having a leaf on each side thereof, each of said leaves being fixedly connected to the door at right angles thereto and having a portion extending a distance beyond the hinged side of the door, said leaves positioned to fit closely adjacent the exterior container wall when the door is closed;

locking means to hold the door in a closed position;

leg means for supporting the container bottom, said leg means defining a loop adapted for entry of the lifting tines of a forklift, and handle means attached to the door at an upper level thereof, said handle means having a configuration generally defining a loop spaced from said door a distance substantially equal to the height of said leg means, whereby said handle means support the door in a horizontal attitude substantially level with the container floor when the door is in fully open position to provide a tray for unloading the container, said tray having relatively shallow sides defined by said leaves and providing a sealing juncture with the container defined by the overlap of the extended leaf portions and the container walls.

2. The storage container of claim 1 wherein said box and door are constructed of stainless steel.

3. The storage container of claim 1 wherein the top edges of said box have a rolled configuration.

* * * * *